US005601368A

United States Patent [19]

Bodolay et al.

[11] Patent Number: 5,601,368

[45] Date of Patent: Feb. 11, 1997

[54] TAMPER-EVIDENT CONTAINER WITH RECLOSABLE FASTENER AND METHOD FOR MAKING

[75] Inventors: William A. Bodolay; Michael J. Bodolay, both of Lakeland, Fla.

[73] Assignee: Lakeland Micro, Inc, Lakeland, Fla.

[21] Appl. No.: 439,130

[22] Filed: May 11, 1995

Related U.S. Application Data

[63] Continuation-in-part of Ser. No. 299,575, Sep. 1, 1995, abandoned.

[51] Int. Cl.[6] ..... B65D 33/34

[52] U.S. Cl. ..... 383/5; 383/61; 383/63; 383/66; 383/209

[58] Field of Search ..... 383/5, 61, 63, 383/64, 65, 66, 207, 209

[56] References Cited

U.S. PATENT DOCUMENTS

| | | | |
|---|---|---|---|
| 2,978,769 | 4/1961 | Harrah | 383/65 X |
| 3,181,583 | 5/1965 | Lingenfelter | 383/66 X |
| 3,532,571 | 10/1970 | Ausnit | 383/65 X |
| 4,335,817 | 6/1982 | Bahr | 383/66 X |
| 4,570,820 | 2/1986 | Murphy | 383/66 X |
| 4,691,373 | 9/1987 | Ausnit | 383/63 |
| 4,848,928 | 7/1989 | Ausnit | 383/65 X |
| 4,902,140 | 2/1990 | Branson | 383/63 X |
| 5,024,537 | 6/1991 | Tilman | 383/63 |
| 5,036,643 | 8/1991 | Bodolay | 383/61 X |
| 5,096,516 | 3/1992 | McDonald et al. | 383/61 X |
| 5,461,845 | 10/1995 | Yeager | 383/66 X |

FOREIGN PATENT DOCUMENTS

| | | | |
|---|---|---|---|
| 719570 | 10/1965 | Canada | 383/209 |
| 528721 | 2/1993 | European Pat. Off. | 383/66 |
| 998967 | 7/1965 | United Kingdom | 383/66 |

*Primary Examiner*—Jes F. Pascua
*Attorney, Agent, or Firm*—David W. Pettis, Jr., P.A.

[57] ABSTRACT

An improved, tamper-evident container having a reclosable zipper-type fastener useful for providing access to the interior of the container is disclosed. The reclosable fastener is characterized by a pair of mating sealing strips wherein each one of the pair is attached to a common surface of the container. The container is further characterized by the provision of a security seal to provide a tamper-evident closure for the container until it is initially opened.

10 Claims, 5 Drawing Sheets

TAMPER-EVIDENT CONTAINER WITH RECLOSABLE FASTENER AND METHOD FOR MAKING

This application is a continuation-in-part of our prior application Ser. No. 08/299,575, filed Sep. 1, 1995, now abandoned.

BACKGROUND OF THE INVENTION

1. Field of the Invention.

The present invention relates to an improved reclosable, tamper-evident container formed, at least in part, from a flexible material. Access to the interior of such a container is provided by a security seal formed through the flexible material, and the reclosable fastener of this invention is attached to the container in sealing relation to that seal. The improved fastener of this invention is particularly characterized by its structure comprising a pair of mating, reclosable sealing strips, both of which are attached to a common surface of the container's flexible material. Preferably, the reclosable fastener of this invention is disposed on the inside surface of the container.

2. Description of the Prior Art.

Reclosable containers utilizing zipper-type fasteners are well known in the packaging industry and are used for holding, displaying and dispensing a wide variety of products ranging from hardware items to food products intended for human consumption. The construction of virtually all such prior art fasteners comprises one or more female parts which releasably receive one or more corresponding male parts. In order to provide access to the interior of the container, those portions of the fastener bearing the respective female and male parts must typically be attached to opposing sides of the container such that the female and male parts will be in registry with each other. A typical such construction is disclosed in U.S. Pat. No. 4,909,017 to McMahon and Spanier.

Obviously, then, according to the present state of the packaging arts, great care and precision are required in the placement and attachment of reclosable fasteners to their related containers. Notwithstanding the existence of a great variety of such fasteners and reclosable containers utilizing such fasteners, it is clear that there remains a great need in the packaging arts for a reclosable, zipper-type fastener, both parts of which can be attached to a single common surface of the material forming a wall of the container before the container is even partially formed. Such a fastener would significantly simplify the manufacturing process for reclosable containers by not interfering with the operation of standard forming and filling machines.

SUMMARY OF THE INVENTION

The present invention relates to an improved tamper-evident container formed from a flexible material and having a reclosable fastener. In a preferred embodiment, the fastener of this invention comprises a pair of mating, reclosable sealing strips, each comprising a strip base segment which is attachable to a common surface of the material forming a wall of a reclosable container. Each of the sealing strips further comprise a second segment integral with its corresponding base segment and free from the container wall surface. One of the strips comprises a male fastener part, and the other of the strips comprises a female fastener part in receiving relation to the male part. Tamper-evident access to the interior of the container is provided by a removable portion of the flexible material to form an aperture for access to the reclosable fastener.

According to a first embodiment of the reclosable fastener, the male fastener part is at the juncture of one of the base segments and its corresponding second segment, and the female fastener part is formed on the second segment of the other sealing strip. Both base segments are attached to a common interior surface of the flexible material, and both second segments are free from the common surface.

According to a second embodiment, the female fastener part is formed on one of the sealing strip second segments, and that second segment is attached to second surface of the flexible material opposite the common surface.

Also disclosed and claimed hereinafter is a method for attaching the reclosable zipper-type fastener to the flexible material from which the container is made so as to provide a tamper-evident reclosable seal.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

A first embodiment of the improved tamper-evident container formed from a flexible material and having a reclosable fastener is generally indicated as 10 in the views of FIGS. 1, 2, 5 and 6. The reclosable fastener is generally indicated as 12.

Figure 1:
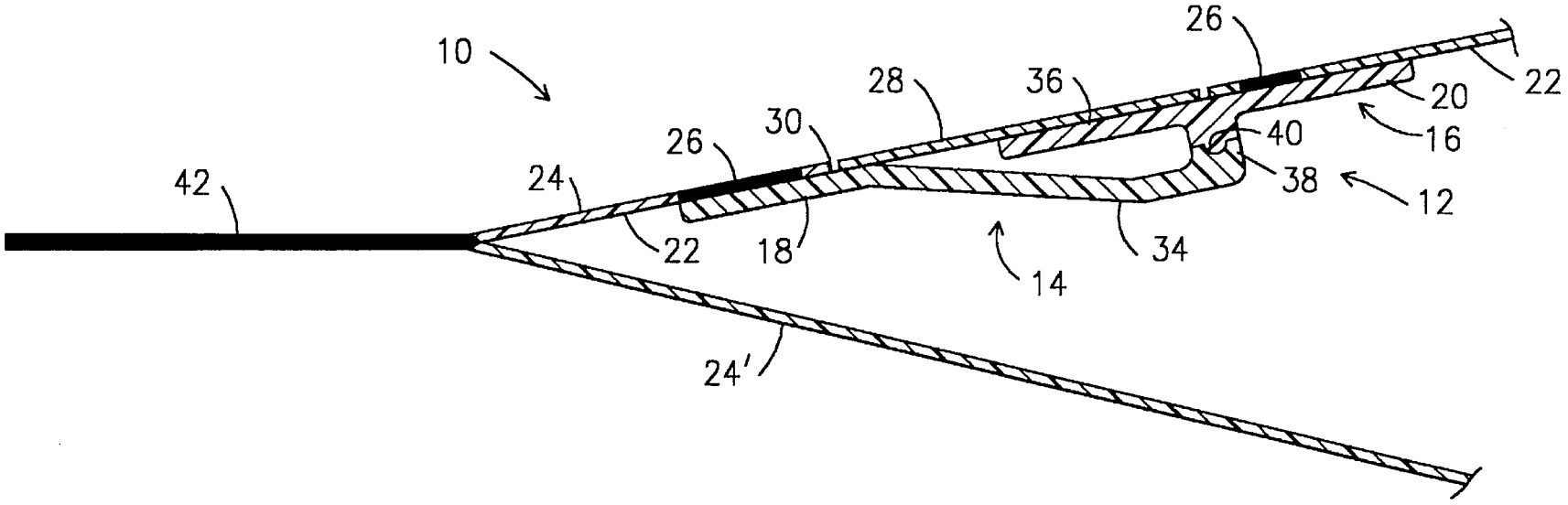
FIG. 1 is a side elevation showing a segment of a first embodiment of the container of this invention with the fastener attached to the inside of a segment of the flexible material at least partially forming a reclosable container.
Figure 2:
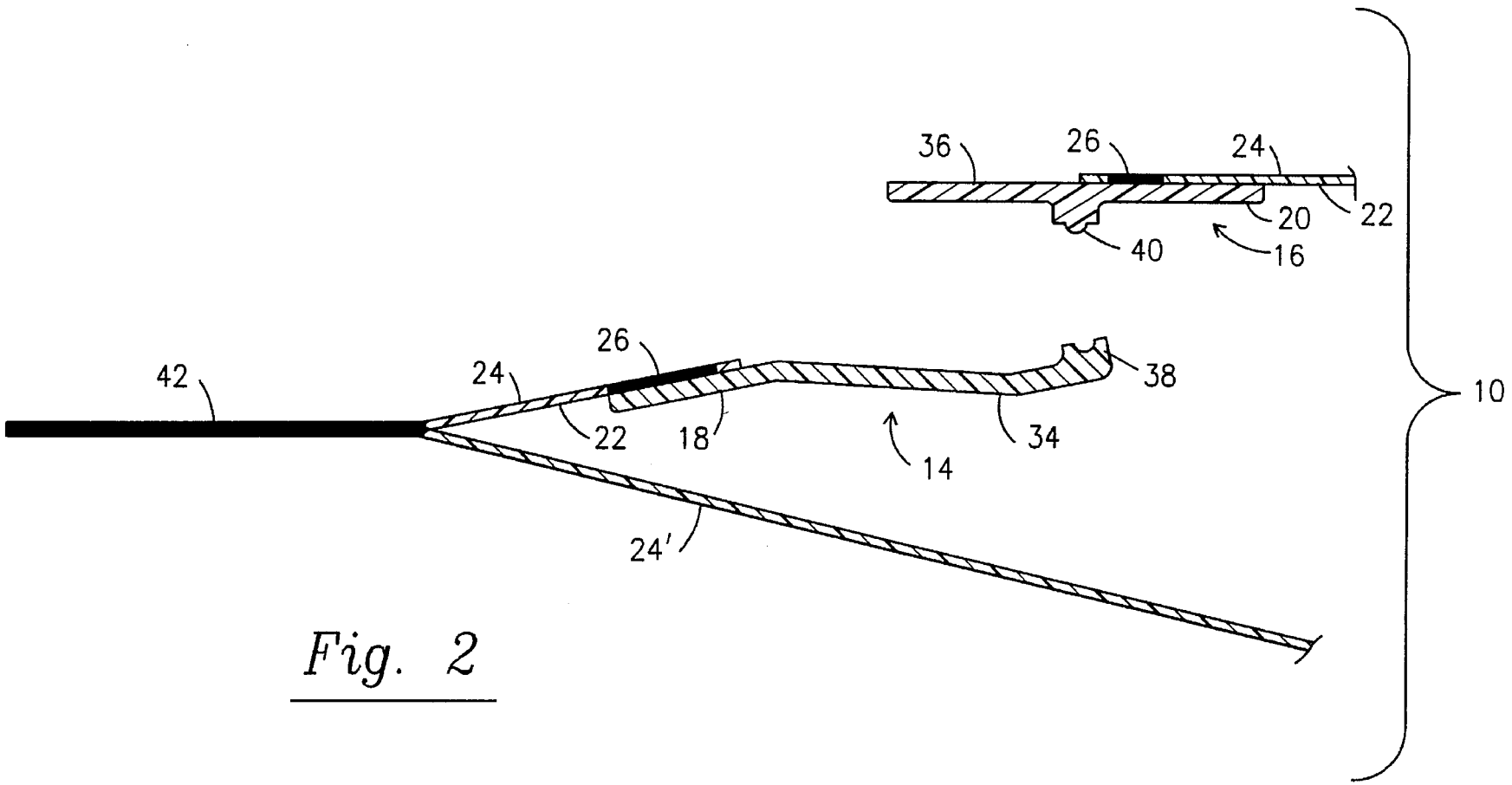
FIG. 2 is a side elevation similar to that of FIG. 1 showing the segment of the reclosable container with the tamper-evident portion removed and the fastener opened.

Referring to the view of FIG. 1, it can be seen that fastener 12 comprises a pair of mating, reclosable sealing strips, generally indicated as 14 and 16, respectively. Each of the sealing strips 14 and 16 comprise a base segment 18 and 20, respectively. Base segment 18 is attached to interior surface 22 of flexible material 24, and base segment 20 is similarly attached to the common interior surface 22. As shown in FIG. 1, attachment of the fastener 12 to common interior surface 22 is indicated by perimeter seal 26.

Figure 6:
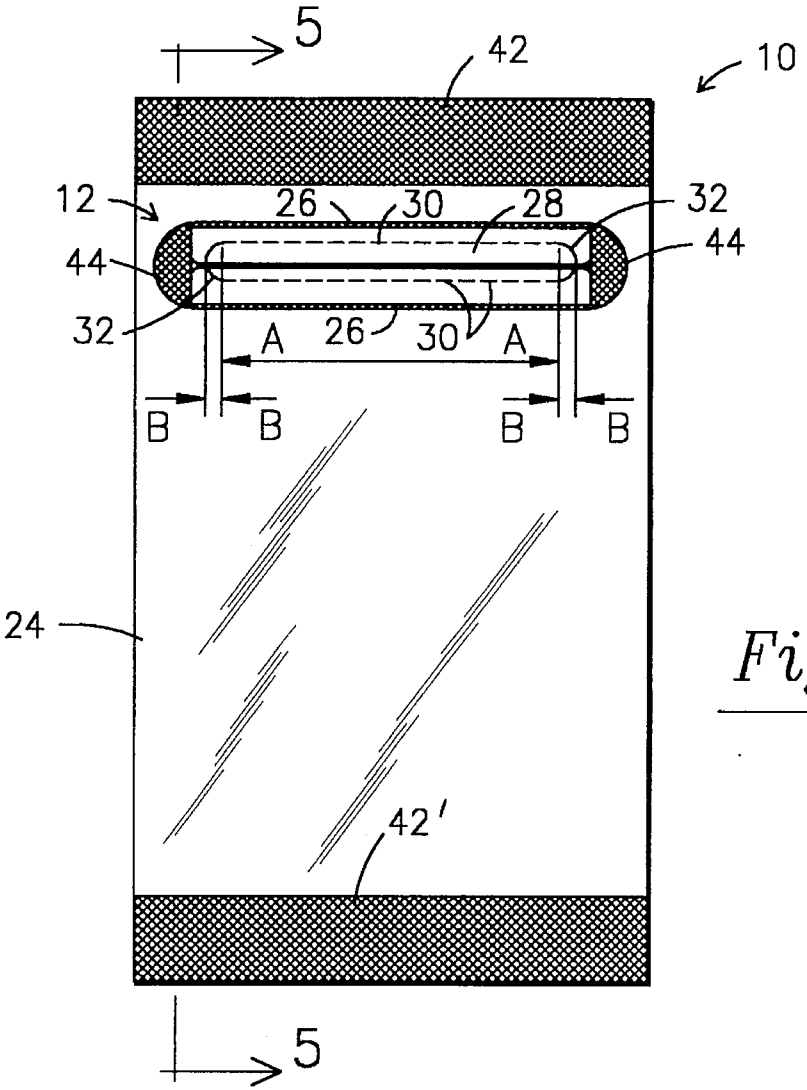
FIG. 6 is a plan view of the reclosable container shown in FIG. 5.
Figure 5:
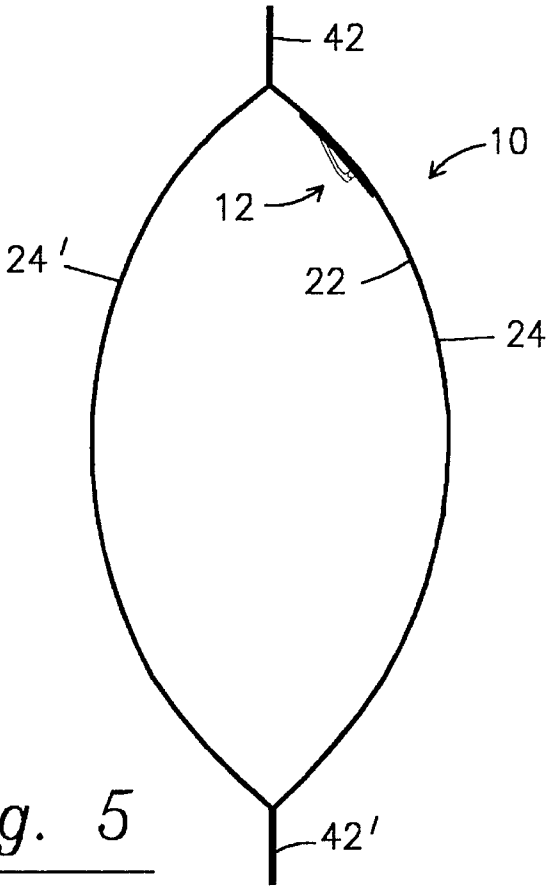
FIG. 5 is a sectional view taken along line 5—5 of FIG. 6 showing attachment of the reclosable fastener to a common interior surface of a reclosable container.

Also shown in the view of FIG. 1 is a removable portion 28 of flexible material 24 by which access to the interior of container 10 may be obtained once portion 28 is removed to form an aperture providing access to strips 14 and 16 whereby they may be separated from each other. This is clearly illustrated in the "opened" view of FIG. 2. Referring to the view of FIG. 6, it can be seen that removable portion 28 is defined by a plurality of cuts formed through flexible material 24. In the preferred embodiment, these cuts comprise a plurality of perforations 30 and at least one slit 32, though a pair of opposed slits 32 are illustrated in the view of FIG. 6. Slit 32 provides a free segment of flexible material 24 whereby portion 28 may be removed to provide access to fastener 12. The perforations 30 are preferably formed within the area defined by line A—A, and the slit, or slits, 32 are preferably formed within the area between arrows B.

Returning to the view of FIG. 1, sealing strip 14 further comprises a second segment 34 integrally formed therewith, but not attached to common interior surface 22. Sealing strip 16 also comprises a second segment 36 integral with its base segment 20, but not attached to common interior surface 22. A female fastener part 38 is formed on second segment 34, and a corresponding male fastener part 40 is formed on sealing strip 16 at the juncture of base segment 20 with second segment 36.

As further shown in the view of FIG. 1, container 10 further includes another segment of flexible material 24' forming another wall thereof, and a seam 42 is provided by the joining of flexible material 24 to a corresponding segment of flexible material 24'. Referring to the views of FIGS. 5 and 6, a similar seam 42' is formed at the bottom of container 10.

Referring to the view of FIG. 6, and remembering that a principal end use for the container 10 is to hold food products intended for human consumption, the formation of an hermetic seal is a particular advantage of this invention. As shown in FIG. 6, the perimeter seal 26 extends around the perimeter of fastener 12. However, a broadened segment 44 can be seen at each end of perimeter seal 26. Broadened segment 44 is frequently referred to in the packaging industry as a "splotch" seal. Such a splotch seal involves the application of heat and pressure to the distal ends of sealing strips 14 and 16 so as to form a flatened, broadened segment 44. Then, when the fastener 12 is attached to common interior surface 22 of flexible material 24 by the perimeter seal 26, an hermetic seal is formed in completely surrounding relation to the removable portion 28.

Figure 3:
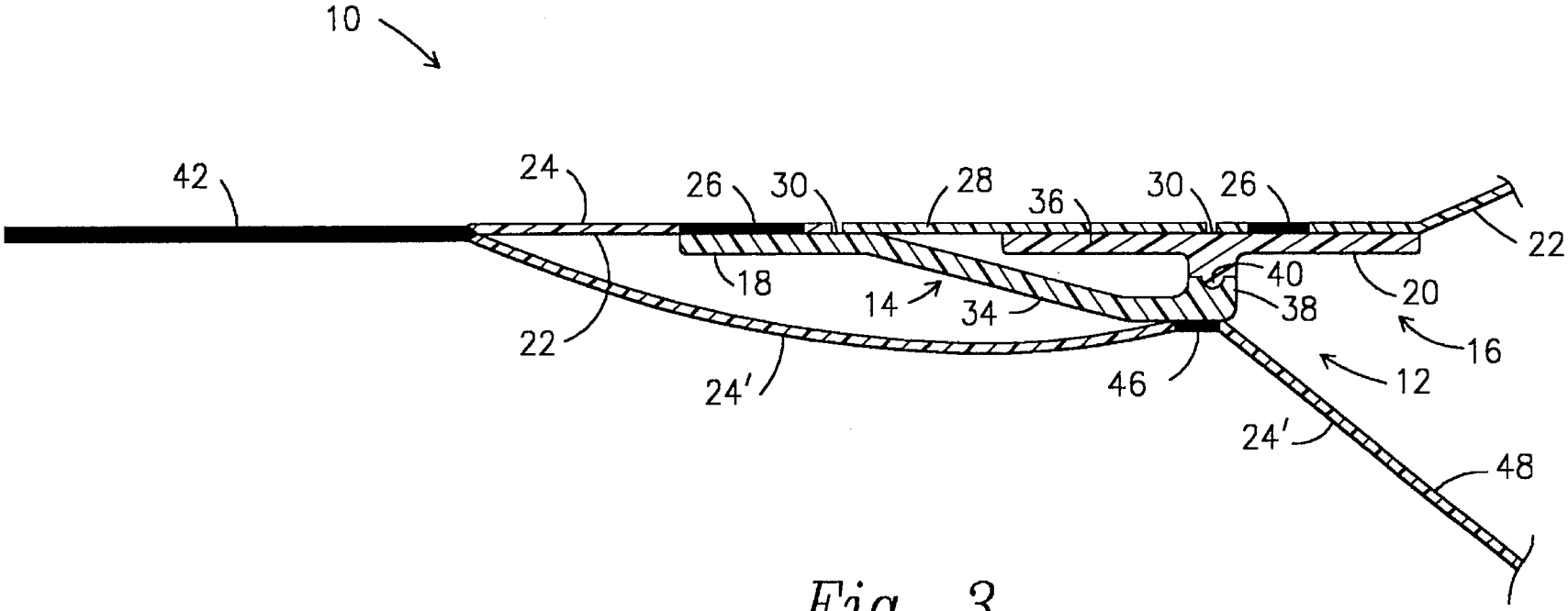
FIG. 3 is a view similar to that of FIG. 1 showing a second embodiment of the container.
Figure 4:
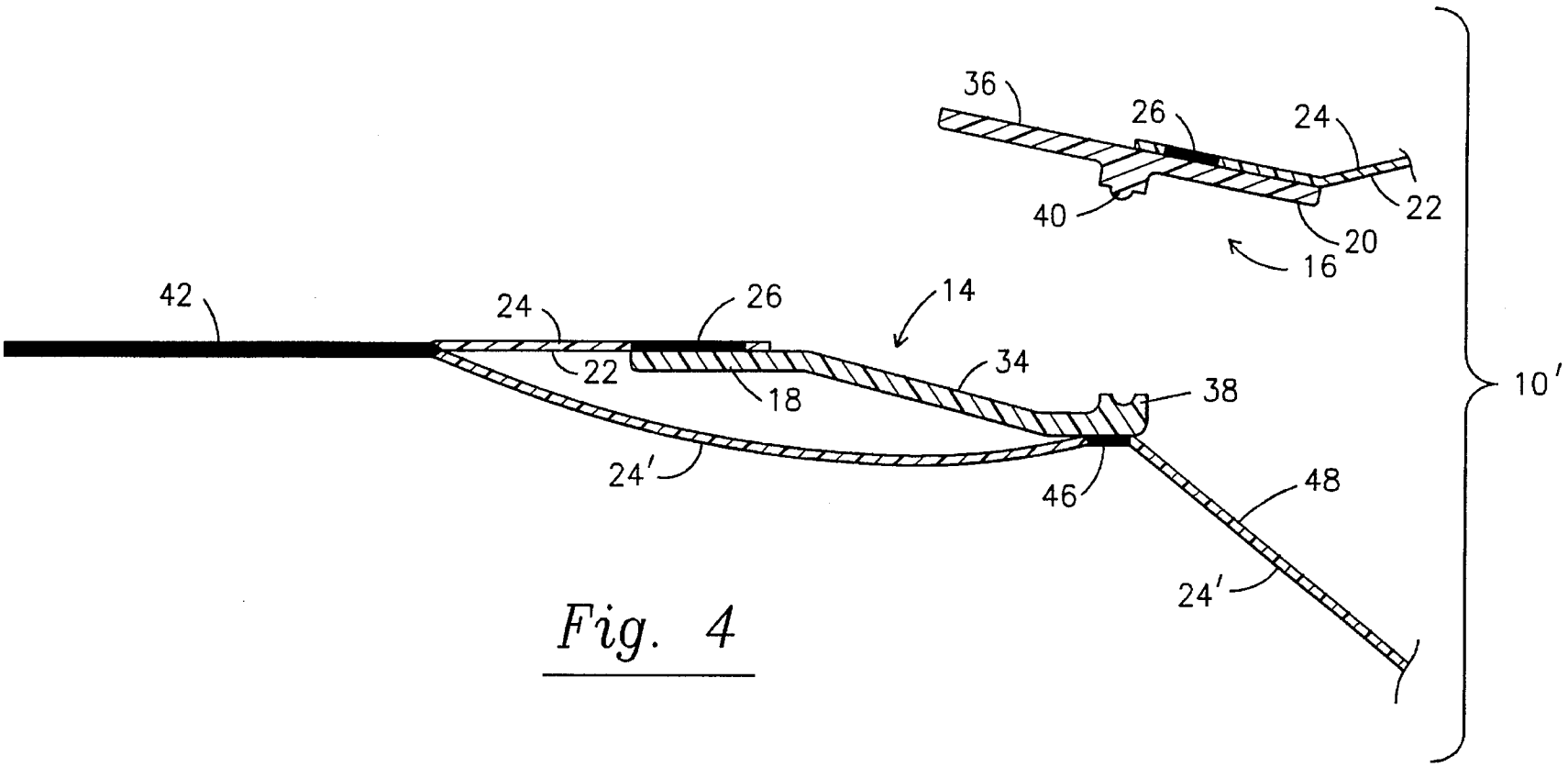
FIG. 4 is a side elevation similar to that of FIG. 3 showing the segment of the reclosable container with the tamper-evident portion removed and the fastener opened.

Referring now to the views of FIGS. 3 and 4, a second embodiment of the tamper-evident container is generally indicated as 10'. Inasmuch as the structural elements of container 10' are essentially identical to those of first embodiment 10, identical reference numerals have been used for their identification. As clearly shown in the views of FIGS. 3 and 4, second embodiment 10' further comprises a tack seal 46 to bond second segment 34 to inside surface 48 of flexible material 24' forming the opposite side of container 10'. Such a construction virtually eliminates any probability of material contained within container 10' becoming wedged or caught in the gap otherwise present between second segment 34 and flexible material 24'.

From the above description of the structure of first and second embodiments of the container 10 and 10', respectively, attention is now invited to the following description of the method for attaching fastener 12 to a flexible material 24 for providing a tamper-evident reclosable opening therethrough. First, a segment of flexible material 24 is selected for forming a container 10. A pluality of cuts comprising perforations 30 and at least one slit 32 are made to define a removable portion 28. Next, a reclosable zipper-type fastener 12 is selected and cut to a predetermined length sufficient to overlie the removable portion 28. Opposed distal ends of fastener 12 are then "splotched" and the splotched length of fastener is disposed in adjacent, overlying relation to removable portion 28. The perimeter seal 26 is formed by the application of pressure and heat. If desired, tack seal 46 would be made in a subsequent step. From that point on, the container would be formed and filled using standard form and fill apparatus and methods. No further manipulation of fastener 12 and its related removable portion 28 is required.

It will thus be seen that the objects set forth above, among those made apparent from the preceding description, are efficiently attained, and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. In an improved tamper-evident container formed at least in part from a flexible material wherein access to the interior of the container is provided by an aperture formed through the flexible material, said aperture being defined by removing a removable portion of said flexible material, the improvement in combination therewith comprising a predetermined length of a reclosable, zipper-type fastener having generally opposed distal ends, each of said distal ends being splotch sealed to form a flattened broadened segment, said fastener attached to said container in sealing relation surrounding said aperture forming an hermetic seal around said removable portion, said fastener comprising: a pair of mating reclosable sealing strips, each of said strips comprising a strip base segment attached to a common inside surface of said flexible material; each of said strips further comprising a second segment integral with its corresponding base segment and free from said common inside surface; one of said strips comprising a male fastener part formed at a junction of one of said second segments and its corresponding base segment and the other of said strips comprising a female fastener part in receiving relation to said male part, and said aperture comprising said removable portion of said flexible material being formed in overlying relation to said second segments.

2. An improved container as in claim 1 wherein said removable portion is defined by a plurality of cuts formed through said flexible material.

3. An improved container as in claim 2 wherein said cuts comprise a plurality of perforations and at least one slit having a longitudinal dimension greater than any one of said perforations.

4. In an improved tamper-evident container formed at least in part from a flexible material wherein access to the interior of the container is provided by an aperture formed through the flexible material, said aperture being defined by removing a removable portion of said flexible material, the improvement in combination therewith comprising a reclosable, zipper-type fastener attached to said container in sealing relation to said aperture, said fastener comprising:

a pair of mating, reclosable sealing strips, each of said strips comprising:

a strip base segment attached to a common surface of said flexible material;

a second segment integral with its corresponding base segment and free from said common surface;

one of said strips comprising a male fastener part and the other of said strips comprising a female fastener part in receiving relation to said male part;

said aperture comprising a removable portion of said flexible material formed in juxtaposed relation to said segments; and each of said sealing strips being attached to an inside surface of said flexible material and one of said segments is attached to a second surface of said flexible material opposite said common surface.

5. An improved container as in claim 4 wherein said second surface is an opposed inside surface of said flexible material.

6. An improved container as in claim 5 wherein said female fastener part is formed on said one second segment and wherein said male fastener part is formed on the other of said second segments.

7. An improved container as in claim 4 wherein said removable portion is defined by a plurality of cuts formed through said flexible material.

8. An improved container as in claim 7 wherein said cuts comprise a plurality of perforations and at least one slit having a longitudinal dimension greater than any one of said perforations.

9. An improved container as in claim 4 wherein said fastener further comprises a pair of generally opposed distal ends, said distal ends being splotch sealed, such that a hermetic seal surrounding the removable portion is formed.

10. An improved container as in claim 9 wherein each respective said splotch seal at the respective said distal ends of said fastener forms a flattened broadened segment.

* * * * *

UNITED STATES PATENT AND TRADEMARK OFFICE

CERTIFICATE OF CORRECTION

PATENT NO. : 5,601,368

DATED : FEB 11, 1997

INVENTOR(S) : WILLIAM A. BODOLAY, et al.

It is certified that error appears in the above-indentified patent and that said Letters Patent is hereby corrected as shown below:

Title page, item [63];

Column 1, line 6, delete "1995" and insert therefor --1994--

Signed and Sealed this

Thirteenth Day of May, 1997

Bruce Lehman

*Attest:*

BRUCE LEHMAN

*Attesting Officer*

*Commissioner of Patents and Trademarks*